United States Patent [19]

Nourse

[11] Patent Number: 4,472,919

[45] Date of Patent: Sep. 25, 1984

[54] PREFABRICATED BUILDING PANEL

[75] Inventor: Jack T. Nourse, Chisago City, Minn.

[73] Assignee: Con-Tex Elements, Inc., Chisago City, Minn.

[21] Appl. No.: 379,896

[22] Filed: May 19, 1982

[51] Int. Cl.[3] ..... E04B 2/58

[52] U.S. Cl. ..... 52/601; 52/309.16; 52/344

[58] Field of Search ..... 52/601, 600, 602, 596, 52/79.1, 309.12, 309.16, 309.17, 344, 349, 348, 319

[56] References Cited

U.S. PATENT DOCUMENTS

| | | | |
|---|---|---|---|
| 657,827 | 9/1900 | McCall | 52/349 |
| 772,476 | 10/1904 | Podmore . | |
| 1,169,985 | 2/1916 | Mickelson . | |
| 1,578,964 | 3/1926 | Duphiney . | |
| 1,940,933 | 12/1933 | Balduf . | |
| 1,963,609 | 6/1934 | Balduf et al. . | |
| 1,982,104 | 11/1934 | Holdsworth | 52/348 X |
| 2,121,962 | 6/1938 | Glass . | |
| 2,192,183 | 3/1940 | Deutsch . | |
| 2,388,880 | 11/1945 | Stitt | 18/47.5 |
| 2,497,887 | 2/1950 | Hilpert . | |
| 2,558,946 | 7/1951 | Fromson . | |
| 2,703,003 | 3/1955 | Ruppel . | |
| 2,909,821 | 10/1959 | Olsen | 24/81 |
| 3,094,813 | 6/1963 | Saxe | 52/344 |
| 3,162,982 | 12/1964 | Monk, Jr. . | |
| 3,232,018 | 2/1966 | MacKean | 52/346 |
| 3,363,371 | 1/1968 | Villalobos | 52/349 X |
| 3,378,982 | 4/1968 | Lanctot | 52/694 |
| 3,469,000 | 9/1969 | Smith | 264/255 |
| 3,732,052 | 5/1973 | Gunia | 425/219 |
| 3,737,511 | 6/1973 | Dillon | 264/256 |
| 3,739,050 | 6/1973 | Koncz et al. | 264/39 |
| 3,760,540 | 9/1973 | Latoria | 52/601 X |
| 3,825,394 | 7/1974 | Pietrowiak | 425/404 |
| 3,885,369 | 5/1975 | Ott | 52/340 |
| 3,965,639 | 6/1976 | Boarini | 52/629 |
| 4,185,423 | 1/1980 | Gutierrez | 52/79.9 |
| 4,205,040 | 5/1980 | Aoyama et al. | 264/233 |
| 4,225,301 | 9/1980 | Eustacchio | 425/88 |
| 4,255,915 | 3/1981 | Muriotto | 52/601 |
| 4,259,050 | 3/1981 | Borcoman | 425/88 |
| 4,320,606 | 3/1982 | GangaRao | 52/125 |

FOREIGN PATENT DOCUMENTS

| | | |
|---|---|---|
| 56-13144 | 9/1981 | Japan . |

OTHER PUBLICATIONS

"Remember The Winter Wind," brochure by Fabcon, Incorporated.

"Building Basics," brochure by Fabcon, Incorporated.

*Primary Examiner*—J. Karl Bell

*Attorney, Agent, or Firm*—Kinney & Lange

[57] ABSTRACT

A prefabricated load-bearing wall panel has a layer of concrete attached to a plurality of spaced apart parallel metal wall studs. The slab support is achieved by flexible bolsters secured at spaced locations to each stud and fastened to a reinforcing mesh embedded in the concrete slab. The bolsters, which are partially embedded in the slab, provide compressive and tensile support for the slab on the studs in a direction generally perpendicular to the general plane of the slab. In addition, the wall panel exhibits a synergistic effect in terms of composite design, wind load strength and shear strength.

16 Claims, 10 Drawing Figures

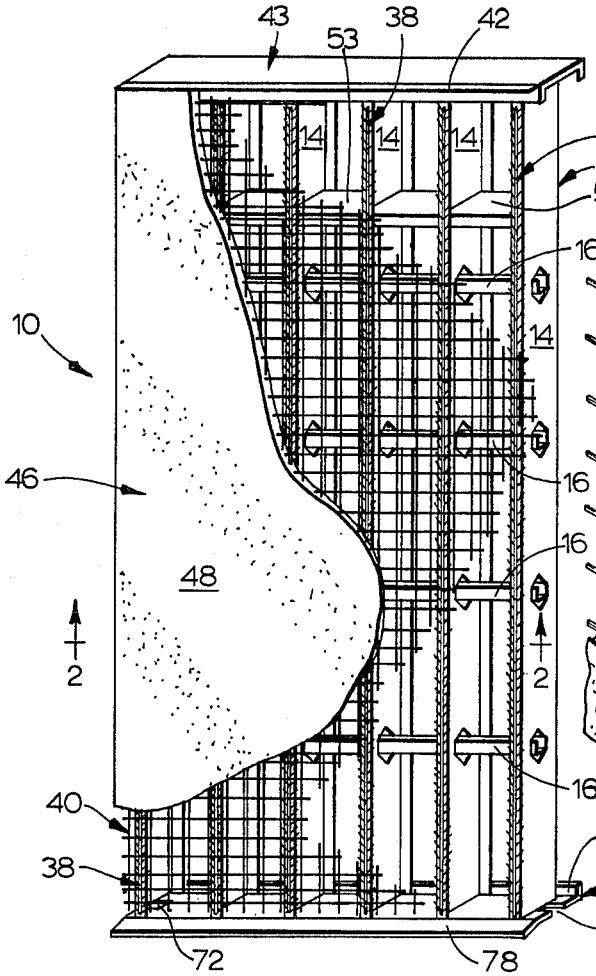
FIG. 1
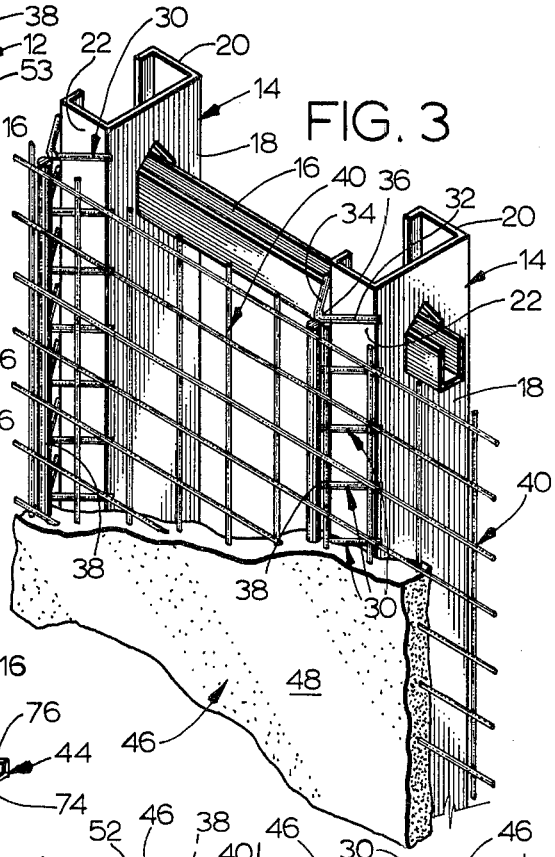
FIG. 3
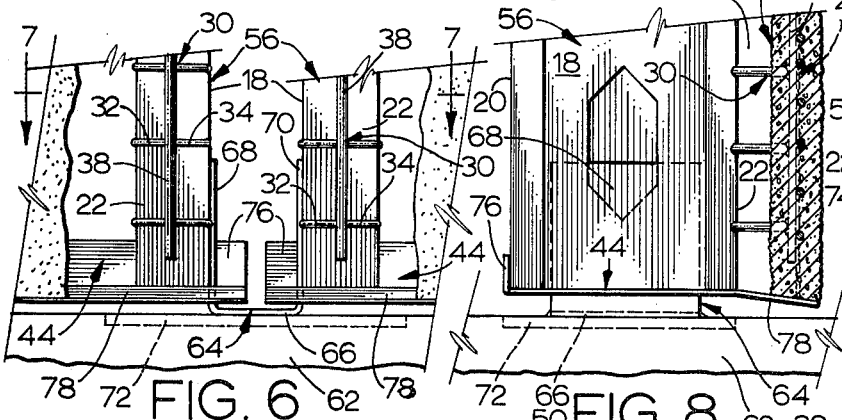
FIG. 6
FIG. 8
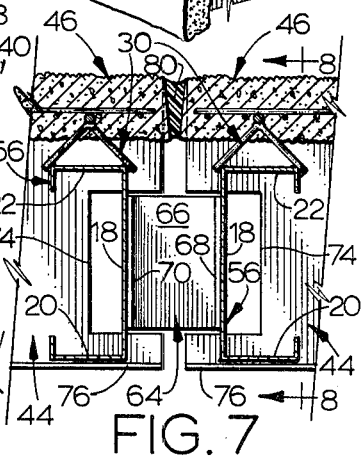
FIG. 7
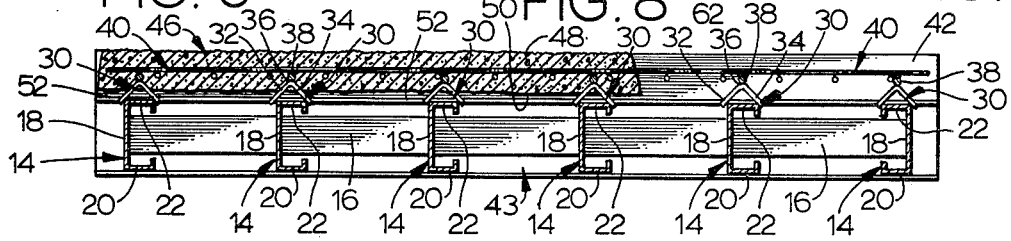
FIG. 2

PREFABRICATED BUILDING PANEL

REFERENCE TO CO-PENDING APPLICATION

Reference is made to co-pending U.S. patent application entitled, "Method and Plant for Producing a Composite Wall Panel", (Ser. No. 379,895) which is filed on even date with the present application and is assigned to the same assignee as the present application.

BACKGROUND OF THE INVENTION

1. Field of the Invention

The present invention relates to prefabricated load-bearing wall panels.

2. Description of the Prior Art

Prefabricated building components, which are manufactured at one site and then transported to the construction site to be assembled, have proved quite useful in the construction industry. The use of prefabricated building components in this manner is favored because of the substantial reduction in labor costs in both the manufacturing and assembly processes. Another construction method employing building components is also quite cost effective. However, in this method the components are not completely prefabricated but are finished at the job site just prior to assembly.

Examples of such building components and these methods of construction are well known. United States Pat. No. 4,185,423 shows a lightweight building module in which a portion of the support columns for each module is embedded in concrete to provide an outer concrete face for the module. U.S. Pat. No. 2,497,887 also shows a wall panel and construction method where the panels are preformed before assembly of the building unit and in which a portion of the supporting columns for each panel is embedded in concrete. This type of building panel design is also shown in U.S. Pat. No. 2,703,003, which shows a wall panel having a lattice secured directly to a plurality of support columns with a concrete panel formed over the lattice and a portion of each column.

Forming panels as described in the above three patents places considerable stress on the concrete when the support columns are called upon to carry the weight of the building. Since at least a portion of the columns is embedded in the concrete, the concrete must compress or fail when the support columns are placed in compression. Similarly, if the support columns are placed in tension, the concrete must likewise tense with the columns or fail. To avoid these problems, the concrete should be secured to the support columns so that the concrete does not carry the weight of the structure. Devices have been conceived for resiliently securing wall panels to load-bearing wall columns. Examples of such devices are shown in U.S. Pat. No. 1,963,609, U.S. Pat. No. 1,940,933, U.S. Pat. No. 2,909,821, and U.S. Pat. No. 3,232,018. The devices of these patents are resilient clips upon which wall panels are hung in spaced relation from wall columns or studs.

Prior art prefabricated wall panels have been constructed with angle iron connectors or clips between the studs and a thin slab of concrete. These connectors consisted of metal L-shaped brackets extending from metal studs and welded to a reinforcing mesh embedded in the concrete panel. This design was found to be unsatisfactory because a normal shear load upon the wall panel caused the connectors to deform or fail, thus permanently damaging the panel unit. In addition, the connectors did not act to transfer loads to the slab of concrete in a manner that caused load to be picked up by the slab. The concrete slab tended to fail in the region of the connection.

Although not specifically related to prefabricated concrete panels, other patents of interest (showing various panels and means for securing panels to studs) are shown in the following U.S. patents:

| Inventor | U.S. Pat. No. |
|---|---|
| Duphiney | 1,578,964 |
| Glass | 2,121,962 |
| Deutsch | 2,192,183 |
| Fromson | 2,558,946 |
| Monk, Jr. | 3,162,982 |
| Lanctot | 3,378,982 |
| Ott | 3,885,369 |
| Boarini | 3,965,639 |
| GangaRao | 4,320,606 |

None of these prior art devices show a prefabricated load-bearing wall panel which has a concrete slab secured to but spaced apart from the wall studs so that the studs are permitted to bend relative to the slab in the general plane of the panel, and so that the slab does not fail upon normal shear loading of the panel, and is able to sustain compressive and tensile stresses relative to the studs.

SUMMARY OF THE INVENTION

The present invention relates to prefabricated load-bearing wall panels. More particularly, the invention relates to the construction of a wall panel which exhibits load bearing capabilities not previously achieved in prior art wall panel designs. The wall panel of the present invention comprises a bolster means mounted on each of a plurality of spaced apart and parallel studs. Each bolster means as shown comprises an elongated rod and a plurality of spacers, with each spacer being a pair of legs joined to the rod at a juncture region and formed into a V-shape. The free ends of the legs of the bolster means are secured at spaced location along the length of each stud with the spacers being positioned on the studs so that the juncture regions are spaced outwardly from the studs and the rod is coextensive with the stud. A reinforcing mesh is fastened to the juncture regions of the legs of each spacer and as shown, the rod is actually attached to the mesh. The spacers may be used without a joining rod, if desired. The mesh is embedded in a generally planar layer or thin slab of concrete. The concrete layer has an outer face and an opposite inner side surface and the spacers are fastened as described so that the legs of the spacers all protrude from the inner side of the layer and hold the studs spaced from the inner side of the slab. The partially embedded bolster means are flexible to permit the concrete layer and the studs to flex in direction along the general plane of the layer and to provide compressive and tensile support for the concrete layer on the studs in a direction generally perpendicular to the general plane of the layer.

While each bolster means as shown has an elongated rod secured to the juncture regions of the leg pairs on each stud, this is not required. When the rods are present, each rod is in turn secured to the reinforcing mesh and embedded in the concrete layer.

In cross section, the studs are formed as substantially C-shaped channels of sheet metal having a base and side walls. Each bolster means is secured to its stud along the longitudinal edges of one of the side walls of the channel. A load support forming a transfer mechanism transfers shear load applied to the studs in a direction parallel to the general plane of the wall panel and perpendicular to the stud length to the concrete layer so that the studs and the concrete layer each bear portions of the load.

Anchor brackets at each side of each panel secure the panels to a structural foundation for a building to be formed from the panel. Each bracket has a pair of upstanding members which are secured to the outermost studs of two adjacent panels to fix their relative position and support them on the foundation. In addition, the brackets provide means for aligning the wall panels so that the outer faces of the adjacent concrete layers are substantially coplanar.

The wall panel of the present invention is also adaptable for use at building corners and where openings are desired in a building. For corners, the concrete layer is formed so that one edge of the layer is formed extending generally perpendicular to the plane of the wall panel. Similarly, for building openings such as windows, at least one of the edges of the layer is formed to extend beyond the ends of the studs and extend generally perpendicular to the plane of the panel to support the window frames and windows in position parallel to the wall panel.

BRIEF DESCRIPTION OF THE DRAWINGS

FIG. 1 is a perspective view of the prefabricated load-bearing wall panel of the present invention with parts broken away.

FIG. 2 is a sectional view taken along line 2—2 of FIG. 1.

FIG. 3 is an enlarged perspective view of a portion of the wall panel with parts broken away.

FIG. 6 is an enlarged front elevation of the anchor means for the wall panel of the present invention with the concrete layer and reinforcing mesh removed.

FIG. 7 is a sectional view as taken along line 7—7 of FIG. 6.

FIG. 8 is a sectional view as taken along line 8—8 of FIG. 7.

DETAILED DESCRIPTION OF THE PREFERRED EMBODIMENTS

Figure 4:
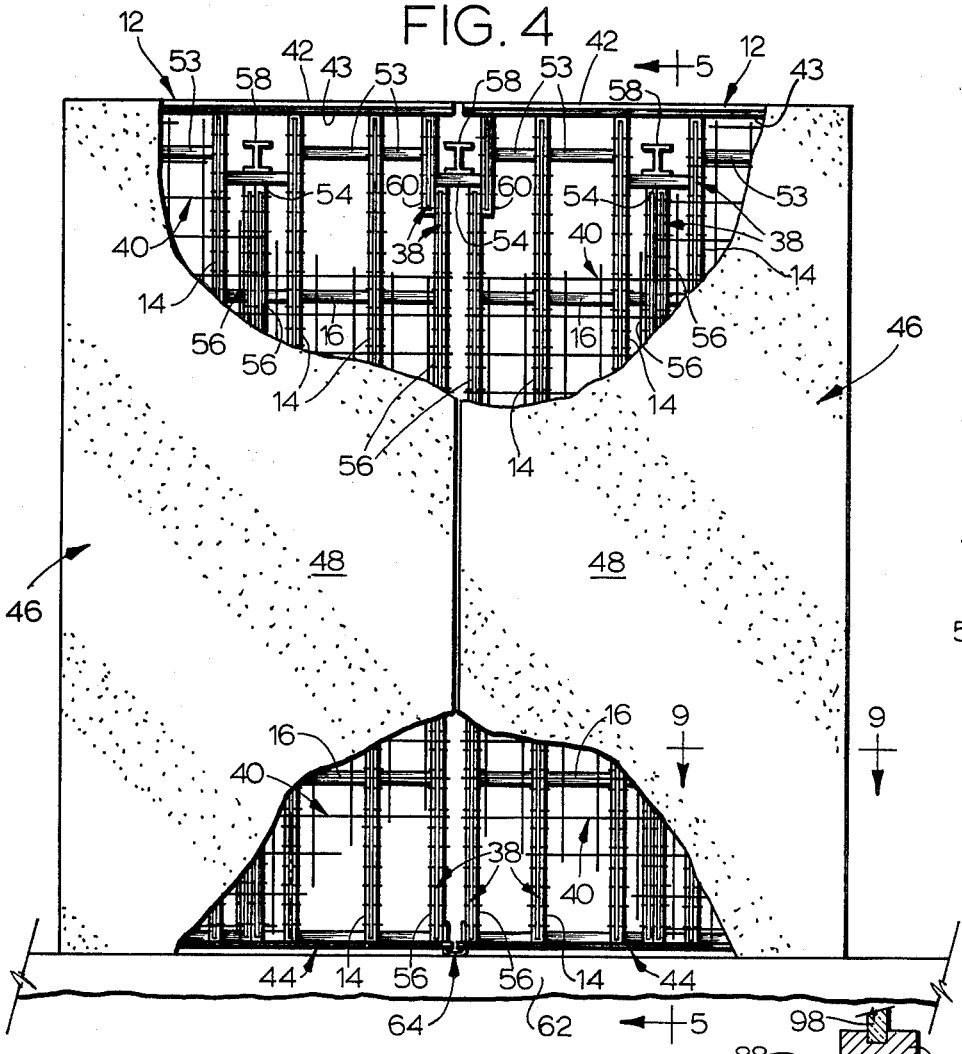
FIG. 4 is a front elevational view of two wall panels of the present invention with parts broken away.

FIG. 1 shows a prefabricated load-bearing wall panel 10 having a structural frame 12. The frame 12 is generally rigid and consists of a plurality of spaced apart parallel elongated studs 14 secured together by a plurality of generally perpendicular braces 16. As shown in FIGS. 2 and 3, each stud 14 is preferably a steel column formed in cross section as a substantially C-shaped channel which has a back web wall 18 and parallel side walls 20 and 22 perpendicularly connected to the web wall 18.

A bolster means is secured along the side wall 22 of each stud 14. Each bolster means comprises a plurality of substantially V-shaped spacers 30. Each spacer 30 in turn comprises a pair of legs, 32 and 34 respectively, joined at a juncture region 36. An elongated rod 38 is fastened to the juncture regions 36 of the spacers 30 of each bolster means. The free ends of legs 32 and 34 of the spacers 30 of each bolster means are fastened (welded) to the longitudinal edges of the side wall 22 of one of the studs 14 so that the juncture regions 36 all extend in the same direction outwardly from the studs 14, as shown in FIGS. 2 and 3. The spacers 30 are spaced apart along the length of both rod 38 and stud 14 and the rod 38 extends substantially parallel to and is spaced from the face of side wall 22 of the respective stud 14.

A standard concrete reinforcing mesh 40 overlies and is bonded to each of the elongated rods 38. The mesh 40 is preferably comprised of vertical and horizontal wires welded together and the mesh 40 is welded at spaced intervals to the rods 38. At the upper end of the wall panel 10, the ends of the vertical wires of mesh 40 are welded to a top molding 42, which in turn is secured (also welded as shown) to a cap channel 43 extending across the upper end of the studs 14. At the lower end of the wall panel 10, the ends of the vertical wires of mesh 40 are welded to a bottom sill 44, which is secured to the lower end of studs 14. The mesh 40 for one wall panel is a unitary piece of welded steel mesh secured to the frame 12 along molding 42, sill 44, and through the bolster means of each stud 14.

A thin, generally planar layer or slab of concrete 46 is held substantially parallel to the studs 14 of the wall panel 10. The concrete layer or slab has an outer face 48 and an opposite inner side 50 which faces and is spaced from the side walls 22 of the studs 14. The entire piece of reinforcing mesh 40 for one wall panel 10 and a portion (including the juncture region 36) of each V-shaped spacer 30 of the bolster means is embedded in the concrete layer 46 and provides a semi-rigid support for the layer 46 from the frame 12. As shown in FIG. 2, the inner side 50 of the concrete layer 46 is spaced from the walls 22 of studs 14 (which lie generally on a common plane) by a gap 52. Each bolster means is partially embedded in the layer 46 so that the legs 32 and 34 of each V-shaped spacer 30 protrude a substantially similar amount (approximately equaling the gap 52) from the inner side 50 of the layer 46. The relative positioning of the various elements of the wall panel 10 is best shown in FIG. 1, where portions of the concrete layer or slab 46 and mesh 40 are broken away.

The wall panel is formed by supporting the studs, bolster means and mesh in a casting bed, with the mesh facing down. A slurry of high strength concrete is poured into the bed to the proper depth to embed the mesh and form the layer. After the concrete hardens or sets, the panel, including the concrete layer is removed from the casting bed.

A wall panel 10 assembled in this manner provides a composite structure wherein the concrete layer 46 can absorb substantial wind loading (loading perpendicular to the plane of the concrete layer 46) without requiring the frame 12 to be sufficiently strong to carry all of the load. The bolster means permits the concrete layer 46 to flex relative to the studs 14 in direction along the general plane of the layer 46, and additionally provides compressive and tensile support for the layer 46 on the studs 14 in a direction generally perpendicular to the general plane of the layer 46. In addition to such factors as wind loading, this composite panel structure also allows the concrete layer 46 to respond to other changes in condition, such as temperature differentials, independently from the frame 12. The bolster means prevents building loads on the frame 12 (such as tension or compression on the studs 14) from being transferred directly to the concrete layer 46.

A prefabricated load-bearing wall panel of this design also conserves energy in structures in which it is used. The depth of the studs 14 (defined by the space between walls 20 and 22 of the studs 14) can be filled with insulation or left as a dead air space. In addition, the gap 52 between the studs 14 and the inner side 50 of the concrete layer 46 provides an additional thermal break of air space so conduction of heat between the layer 46 and the studs 14 is minimized for energy conservation purposes.

Adjacent the upper end of the frame 12, a series of cross members 53 are secured perpendicularly to the studs 14. The cross members 53 cooperate with the studs 14 to form a load transfer mechanism for transferring a portion of shear loads exerted on the frame 12 (in direction generally perpendicular to the length of studs 14 and parallel to the general plane of the layer 46) to the concrete layer 46 so that the studs 14 and the layer 46 each bear portions of the load. Such shear forces generally occur adjacent the roof line of a structure, and may result from wind loads on the walls of the building perpendicular to the wall panel 10 shown. The loads are carried by the cross members 53 to the studs 14 where a portion of the load is transferred through the legs 32 and 34 of the spacers 30 to the concrete layer 46. Thus, the studs 14 and layer 46 exhibit a composite reaction to shear loads on the wall panel 10.

The V-shape of the legs of spacers 30 is an efficient design to transfer loads from the frame 12 to the concrete layer 46. Preferably, the legs 32 and 34 of each spacer 30 are disposed at an 90° angle relative to each other (and 45° relative to the plane of the concrete layer) to provide the optimum load transfer. In addition, because there are a large number of spacers 30, and each spacer 30 will flex, there is a sharing of loads on the bolster means all along the length of the studs 14 so that loads between the studs 14 and the concrete layer 46 are spread evenly across the plane of the layer 46. This load sharing reduuces the possibility of a "stress raiser" connection which leads to failure at any one point on the wall panel 10.

Figure 5:
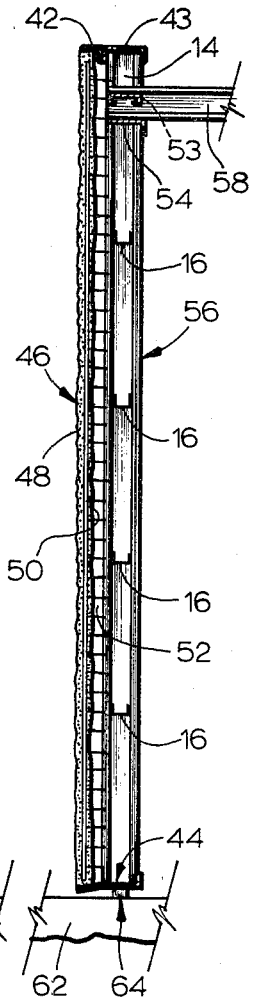
FIG. 5 is a sectional view taken along line 5—5 of FIG. 4.

FIG. 4 shows two wall panels 10 mounted adjacent each other with the outer faces 48 of their respective concrete layers 46 positioned substantially coplanar. The frames 12 of these wall panels 10 include additional support braces 54 positioned generally perpendicularly to the studs 14, as shown. Each support brace 54 is mounted upon the upper end of at least one shortened stud 56 in the frame 12. The shortened studs 56 and support braces 54 provide means on the frame 12 for supporting additional structural components on the frame 12, such as a horizontal roof or ceiling beam 58, as shown in FIGS. 4 and 5. A building's roof weight may be supported by the frame 12 by either the studs 14 (with the weight applied upon cap channel 43) or the studs 56 (with the weight applied upon the support braces 54). Of course, other means of supporting the roof or ceiling decking structure from the wall panels 10 are also possible.

When the shortened studs 56 are the outermost studs at the side of a wall panel 10, additional stud sections 60 are secured to the shortened studs 56 to form a continuous support column from the the cap channel 43 to the bottom sill 44 in order to maintain the structural integrity of the frame 12. The shortened studs 56 and additional stud sections 60 also have bolster means secured thereon in the same manner as the studs 14. The relative positioning of these features are best shown in FIG. 4, where portions of the concrete layer 46 and mesh 40 are broken away.

Each wall panel 10 is secured to a structural foundation 62 (which is a concrete slab as shown) by a U-shaped anchor 64 positioned at each bottom corner of the frame 12. FIG. 4 shows the relative position of the anchor 64 with respect to two adjacent wall panels 10, and FIGS. 6, 7 and 8 are enlarged views of the anchor 64 shown in FIG. 4. The U-shaped anchor 64 consists of a pair of generally parallel members 68 and 70 extending upwardly from a base portion 66. The members 68 and 70 are separately secured to the back web walls 18 of the outermost studs 56 (or the studs 14 in a panel as shown in FIG. 1) of the adjacent wall panels 10, as shown in FIGS. 6 and 7. Each wall panel 10 is secured to the anchor 64 so that the panel 10 is positioned over the foundation 62 in an upstanding generally vertical position, as shown in FIGS. 5 and 8. Prior to securing the anchor 64 to the studs 56, the wall panel 10 is adjustable vertically relative to the foundation 62 so that adjacent panels can be secured at substantially the same height relative to the foundation 62. Preferably, the base portion 66 of anchor 64 is bonded to an anchor plate 72 which, in turn, is bonded to the foundation 62. The anchor plate 72 is shown embedded into the foundation 62.

As stated, a bottom sill 44 (shaped as an angle iron) is secured to the lower ends of the studs of the frame 12. The sill 44 runs along the entire length of the bottom of the frame and has notches 74 at its outermost ends to accommodate the anchors 64, as best shown in FIG. 7. Each notch 74 and anchor 64 cooperate to align the outer faces 48 of adjacent wall panels substantially coplanar and thus provide a smooth and esthetic transition between adjacent concrete layers 46.

Each sill 44 has an upstanding flange 76 adjacent the sides 20 of the studs 14 or 56 and a downwardly extending ramp 78 at the lower end of the concrete layer 46, as best shown in FIG. 8. The ramp 78 (to which the mesh 40 is bonded) provides a means for collecting and draining water that otherwise may be trapped in the gap 52 of the wall panel 10. In addition, the ramp 78 provides a run-off for water, such as condensation, to drain it away from the wall panel 10. The ramp 78 is contiguous to the lower edge of the concrete layer 46 and forms a stop or form for the slurry of concrete when it is poured.

As best shown in FIGS. 2 and 7, the cap channel 43, top molding 52, bottom sill 44, and concrete layer 46 all extend a similar distance past the outermost studs at each side of the wall panel 10. The frame 12 is thus completely hidden by the layer 46 when viewed from the normal outside of the wall panel 10, as shown in FIGS. 4 and 7. The small gap 80 between the side edges of the layers 46 of adjacent wall panels 10 is preferably caulked or filled for a weather seal that permits expansion and contraction to present a unitary face for the outside of a structure constructed with wall panels 10 of the present invention.

Figure 9:
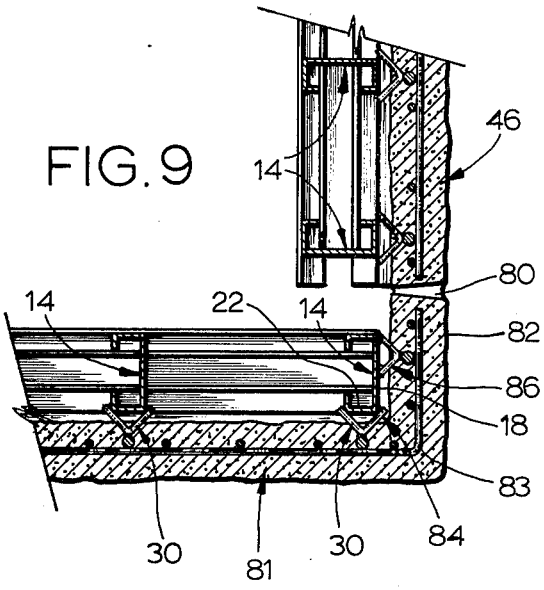
FIG. 9 is a sectional view taken along line 9—9 of FIG. 4.

At building or structure corners, a concrete layer 81 (which corresponds to the concrete layer 46) of one of the wall panels adjacent the corner is formed to integrally turn the corner. As shown in FIG. 9, the concrete layer 81 extends past the side of the frame 12 and has a corner portion 82 extending generally perpendicular to the plane of the concrete layer 81. The outermost stud 14 of the frame 12 at the corner is provided with two bolster means. A first bolster means 84 is secured to the side wall 22 of the outermost stud 14 as previously described and a second bolster means 86 is secured to the back web wall 18 of the stud 14 to provide a resilient means to support a bent portion of a concrete reinforcing mesh 83 (which corresponds to the mesh 40) embedded in the concrete layer 81 and the corner portion 82 of the concrete layer 81 from the frame 12. The corner portion 82 of the concrete layer 81 extends at right angles beyond the side wall 20 of the stud 14 for alignment with the side edge of the next adjacent concrete layer 46 around the corner of the building, as shown. The reinforcing mesh 83 is also integrally formed to bend around the corner for reinforcing the concrete layer 81 and corner portion 82, and is secured to the second bolster means 86 in the same manner as previously described.

Figure 10:
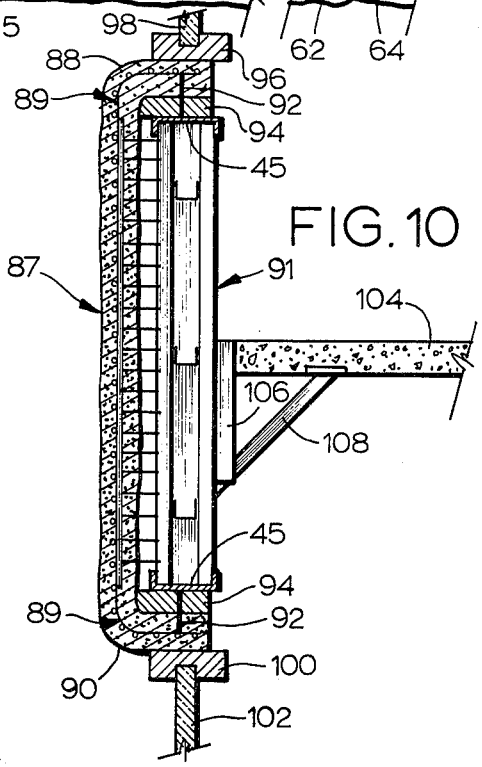
FIG. 10 is a sectional view of the wall panel of the present invention showing the means for supporting windows above and below the wall panel.

The wall panels, as shown in FIG. 10, can be used in multi-story buildings and supported on the framework of such buildings at the midsections of the panels. In such a case, the upper part or the wall panel extends above the floor and supports windows or a glazing system, while the lower part of the wall panel extends below the floor and supports the tops of the windows or glazing system of the floor below. The concrete layer of the wall panel is formed to integrally extend past the top or bottom of its studs to form a generally horizontal mounting portion upon which window and door frames is secured.

As shown in FIG. 10, a concrete layer 87 (which corresponds to the concrete layer 46) has upper and lower generally horizontally extending portions 88 and 90. A reinforcing mesh 89 (which corresponds to the mesh 40) is embedded in the concrete layer 87 and is bent to have horizontally extending portions embedded in the portions 88 and 90 as shown. The studs 91 (which correspond to the studs 14) have cap channels 45 at both their upper and lower ends, and the horizontally extending portions of the mesh 89 are secured to the cap channels 45 at both ends by hook means 92. The horizontally extending portions 88 and 90 of the concrete layer 87 are spaced from the cap channels 45 by foam spacer blocks 94. The concrete layer 87 is fastened along the length of the studs 91 by bolster means as previously described. As shown, the generally horizontal portion 88 of the concrete layer 87 supports a window frame 96 for a window 98 above the wall panel. Similarly, the generally horizontally extending portion 90 of the concrete layer 87 supports a window frame 100 for a window 102 below the wall panel. The glazing system of a building is thus supported by the wall panels of the present invention, as shown in FIG. 10.

Means for supporting the wall panels in multi-story buildings are also shown in FIG. 10. A horizontal section 104 of a building's poured concrete floor is shown. The horizontal section 104 could be decking or a steel framework, however. The selected ones of the studs 91 of the each wall panel are secured to fasteners which in turn are supported on the horizontal section 104. The horizontal section 104 has embedded metal clips or a metal brace supported thereby and vertical angle is on brackets 106 are welded to the embedded metal parts at desired locations corresponding to the portion of selected ones of the studs 91. The brackets 106 are parallel to the studs and extend for a desired length downwardly. The vertical bracket (angle iron) 106 is additionally supported on the horizontal section 104 by a gusset or brace 108 welded to a clip on the horizontal section 104 extending downwardly from the horizontal section 104 to be welded to the corresponding vertical angle iron brackets 106, as shown in FIG. 10. There usually are at least three of the angle iron sections 106 for supporting each wall panel in position, one attached to each end stud in the wall panel and one at a center stud. More of the angle iron brackets 106 may be used if desired.

The brackets 106 are welded to their desired studs while the wall panels are held in proper position. The brackets 106 can be adjusted to be vertical and properly positioned prior to the time they are welded to the provided portions of the horizontal section 104 and before gussets 108 are welded in place.

This unique means of supporting the wall panel off of the floor structure additionally facilitates the load bearing capabilities of the wall panel as described. Wind loads are absorbed primarily by the wall panel and shear loads are generally absorbed by the concrete layer 87 and the studs 91.

It is understood that panels of many different dimensions and shapes are possible: continuous flat panels, corner panels, panels with openings for windows or doors, and panels having designs formed in the outer face of the concrete layer. The panels of the present invention are light in weight, easier to transport and provide adequate space for insulation. The panels are open and easily insulated.

Although the present invention has been described with reference to preferred embodiments, workers skilled in the art will recognize that changes may be made in form and detail without departing from the spirit and scope of the invention.

What is claimed is:

1. A prefabricated load bearing wall panel comprising:

a plurality of spaced apart and parallel elongated studs;

bolster means comprising a plurality of substantially V-shaped pairs of legs, the two legs of each pair being joined at a juncture region, the legs being secured to the studs at spaced location along the length of each stud so that each stud has a plurality of pairs secured thereon, the pairs being positioned on the studs so that the juncture region of each pair extends in a common direction outwardly from the studs;

a concrete reinforcing mesh supported on the bolster means, the juncture region of each pair being fastened to the mesh;

a generally planar layer of concrete having an outer face and an opposite inner side, the concrete layer embedding the reinforcing mesh so that the legs of the pairs protrude from the inner side of the layer, the bolster means permitting the concrete layer to flex relative to the studs in direction of the general plane of the layer, and the bolster means providing compressive and tensile support for the layer relative to the studs in a direction generally perpendicular to the general plane of the layer.

2. The wall panel of claim 1 wherein each elongated stud is formed as a substantially C-shaped channel, the stud having a back web wall and a pair of generally parallel side walls connected to the web wall, and the bolster means being secured to the stud along one of the side walls.

3. The wall panel of claim 1 wherein the bolster means includes a plurality of elongated rods, each rod being secured to the juncture regions of the pairs secured on one of the studs so that the rod is fastened and aligned substantially parallel to the stud, and the rod being secured to the reinforcing mesh embedded in the concrete layer.

4. The wall panel of claim 1, further comprising:

a load transfer mechanism for transferring shear load applied to the studs in direction parallel to the general plane of the layer to the concrete layer so that the studs and layer each bear portions of the shear load.

5. The wall panel of claim 4 wherein the transfer mechanism comprises:

a plurality of braces secured generally perpendicularly between the studs, the braces being spaced apart and combining with the studs to form a structural frame for the wall panel.

6. The wall panel of claim 5 wherein the concrete layer extends past the frame at the side edges of the panel so that no portion of the frame is visible from the outer face of the layer.

7. The wall panel of claim 1, further comprising:

a sill extending across a lower edge of the wall panel, the sill having an upwardly extending lip along an inner side adjacent the studs and a downwardly extending ramp along an outer side at the bottom edge of the concrete layer to thereby provide a drain for water in direction outwardly from the studs.

8. The wall panel of claim 1 wherein a stud is positioned adjacent each side edge of the panel, further comprising:

a sill extending across a lower edge of the panel;

a foundation for the panel, the panel being positioned over the foundation in an upstanding generally vertical position; and a plurality of anchor brackets, the brackets being secured to the foundation and spaced apart so that one bracket is aligned between the studs at the side edges of adjacent panels on the foundation, each bracket having a pair of upstanding members which are separately secured to the studs of the adjacent panels, and the brackets aligning the wall panels so that the outer faces of adjacent concrete layers are substantially coplanar.

9. The wall panel of claim 8 wherein the concrete layer extends past the studs adjacent the side edges of the panel and each end of the sill on each panel is notched to accommodate the anchor brackets.

10. The wall panel of claim 1 wherein the concrete layer is formed so that at least one of the edges of the layer has an integrally formed corner portion extending generally perpendicularly to the plane of the layer.

11. The wall panel of claim 1, further comprising:

a sill extending across a lower end of the wall panel and bonded to the panel frame; and a top molding extending across an upper end of the wall panel and bonded to the panel frame, and the ends of the mesh at the upper and lower ends of the wall panel being bonded to the sill and top molding.

12. The wall panel of claim 4, further comprising:

means on the frame for supporting additional building components such as a plurality of generally horizontal beams.

13. A modular wall panel characterized as comprising:

a series of parallel metal studs and intervening braces forming a rigid framework;

semi-rigid spacers bonded at spaced intervals across the outer edge of each of said studs and in alignment;

a reinforcing rod bonded to said spacers along each of said studs;

a reinforcing mesh overlying and bonded to said reinforcing rods; and said mesh, rods and portions of the spacers being embedded within a thin continuous hardened concrete layer, resulting in a modular wall panel providing load carrying capabilities greater than the rigid framework in terms of wind load resistance and shear strength.

14. The modular wall panel of claim 13 wherein each stud has a back web wall and a pair of generally parallel side walls connected to the web wall, and the spacers being secured to the stud along one of the side walls.

15. The modular wall panel of claim 13, further comprising:

a sill extending across a lower end of the wall panel and bonded to the panel frame; and a top molding extending across an upper end of the wall panel and bonded to the panel frame, the ends of the mesh at the top and bottom of the wall panel being bonded to the sill and top molding.

16. The modular wall panel of claim 13, wherein the intervening braces constitute a load transfer mechanism for transferring shear load applied to the studs in direction generally perpendicular to the length of the studs and parallel to the general plane of the layer to the concrete layer so that the studs and layer each bear portions of the shear load.

* * * * *